US008794757B2

(12) United States Patent
Hirata

(10) Patent No.: US 8,794,757 B2
(45) Date of Patent: Aug. 5, 2014

(54) RECORDING APPARATUS WITH STOPPER DEVICE

(75) Inventor: Kenichi Hirata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 74 days.

(21) Appl. No.: 13/430,997

(22) Filed: Mar. 27, 2012

(65) Prior Publication Data

US 2013/0050374 A1 Feb. 28, 2013

(30) Foreign Application Priority Data

Aug. 31, 2011 (JP) ..... 2011-189051

(51) Int. Cl.
*B41J 2/01* (2006.01)
*B41J 2/215* (2006.01)

(52) U.S. Cl.
USPC ..... 347/104; 347/101; 347/103

(58) Field of Classification Search
CPC ..... B41J 2/215
See application file for complete search history.

(56) References Cited

U.S. PATENT DOCUMENTS 5,613,672 A * 3/1997 Tanaka et al. ..... 271/162
6,550,763 B2 * 4/2003 Gordon et al. ..... 271/189
7,570,397 B2 * 8/2009 Gutierrez et al. ..... 358/474
8,075,127 B2 * 12/2011 Sugahara ..... 347/102
2007/0297821 A1 * 12/2007 Yamauchi et al. ..... 399/52
2009/0200730 A1 * 8/2009 Hirokawa et al. ..... 271/207
2009/0309294 A1 12/2009 Sugizaki et al.
2012/0299236 A1 * 11/2012 Fujita et al. ..... 271/96

FOREIGN PATENT DOCUMENTS

JP H05-011529 A 1/1993
JP H11-217151 A 8/1999
JP 2003-040516 A 2/2003
JP 2009-298591 A 12/2009

* cited by examiner

*Primary Examiner* — Manish S Shah
*Assistant Examiner* — Jeremy Delozier
(74) *Attorney, Agent, or Firm* — Baker Botts L.L.P.

(57) ABSTRACT

A recording apparatus includes a recorder, a conveyer, a holder, a stopper, an urging member, a light source, and a light controller. The recorder records an image on a recording medium at a recording position. The conveyer conveys a recording medium through the recording position and outputs the recording medium along an output direction. The holder holds a recording medium output by the conveyer. The stopper is disposed downstream of the holder along the output direction and contacts an end of a recording medium when the recording medium is output and the stopper is in a first position. The stopper moves between the first position and a second position, in which an end of the stopper is farther to the holder. The urging member urges the stopper to move to the first position from the second position. The light controller controls the light source to illuminate the stopper.

29 Claims, 10 Drawing Sheets

RECORDING APPARATUS WITH STOPPER DEVICE

CROSS-REFERENCE TO RELATED APPLICATION

This application claims priority to Japanese Patent Application No. 2011-189051, filed Aug. 31, 2011, which is incorporated herein by reference.

BACKGROUND OF THE INVENTION

1. Field of the Invention

The invention generally relates to recording apparatus with stopper device, which records an image on a recording medium.

2. Description of Related Art

A known recording apparatus includes a recorder, a conveyer, a holder, and a stopper. The recorder records an image on a recording medium. The conveyer conveys the recording medium through a recording position where the recorder records the image on the recording medium. The conveyer then outputs the recording medium with the image recorded thereon in an output direction. The holder holds the recording medium output by the conveyer. The stopper is disposed downstream of the holder in the output direction and is positioned to contact a downstream end of the recording medium in the output direction.

SUMMARY OF THE INVENTION

When the conveyer outputs forcefully recording media, the recording media may be ejected out of the holder without contacting the stopper. Therefore, a need has arisen for a recording apparatus that overcomes this shortcoming.

According to an aspect of the invention, a recording apparatus described herein may comprise a recorder, a conveyer, a holder, a stopper, and an urging member. The recorder may be configured to record an image on a recording medium at a recording position. The conveyer may be configured to convey a recording medium through the recording position and to output the recording medium along an output direction. The holder may be configured to hold a recording medium output by the conveyer. The stopper may be disposed downstream of the holder along the output direction. The stopper may be configured to contact an end of a recording medium when the recording medium is output by the conveyer and the stopper is in a first position. The stopper may be configured to move selectively between the first position and a second position, in which an end of the stopper is farther to the holder than when in the first position. The urging member may be configured to urge the stopper to move to the first position from the second position.

According to another aspect of the invention, a recording apparatus described herein may comprise a recorder, a conveyer, a holder, a stopper, a light source, and a light controller. The recorder may be configured to record an image on a recording medium at a recording position. The conveyer may be configured to convey the recording medium through the recording position and to output the recording medium along an output direction. The holder may be configured to hold a recording medium output by the conveyer. The stopper may be disposed downstream of the holder in the output direction. The stopper may be configured to contact an end of a recording medium when the recording medium is output by the conveyer and the stopper is in a first position. The light source may be configured to illuminate the stopper. The light controller may be configured to control the light source.

Other objects, features, and advantages will be apparent to persons of ordinary skill in the art from the following detailed description of embodiments of the invention and the accompanying drawings.

BRIEF DESCRIPTION OF THE DRAWINGS

For a more complete understanding of the present invention, needs satisfied thereby, and the objects, features, and advantages thereof, reference now is made to the following descriptions taken in connection with the accompanying drawings.

DETAILED DESCRIPTION OF EMBODIMENTS OF THE INVENTION

Figure 1:
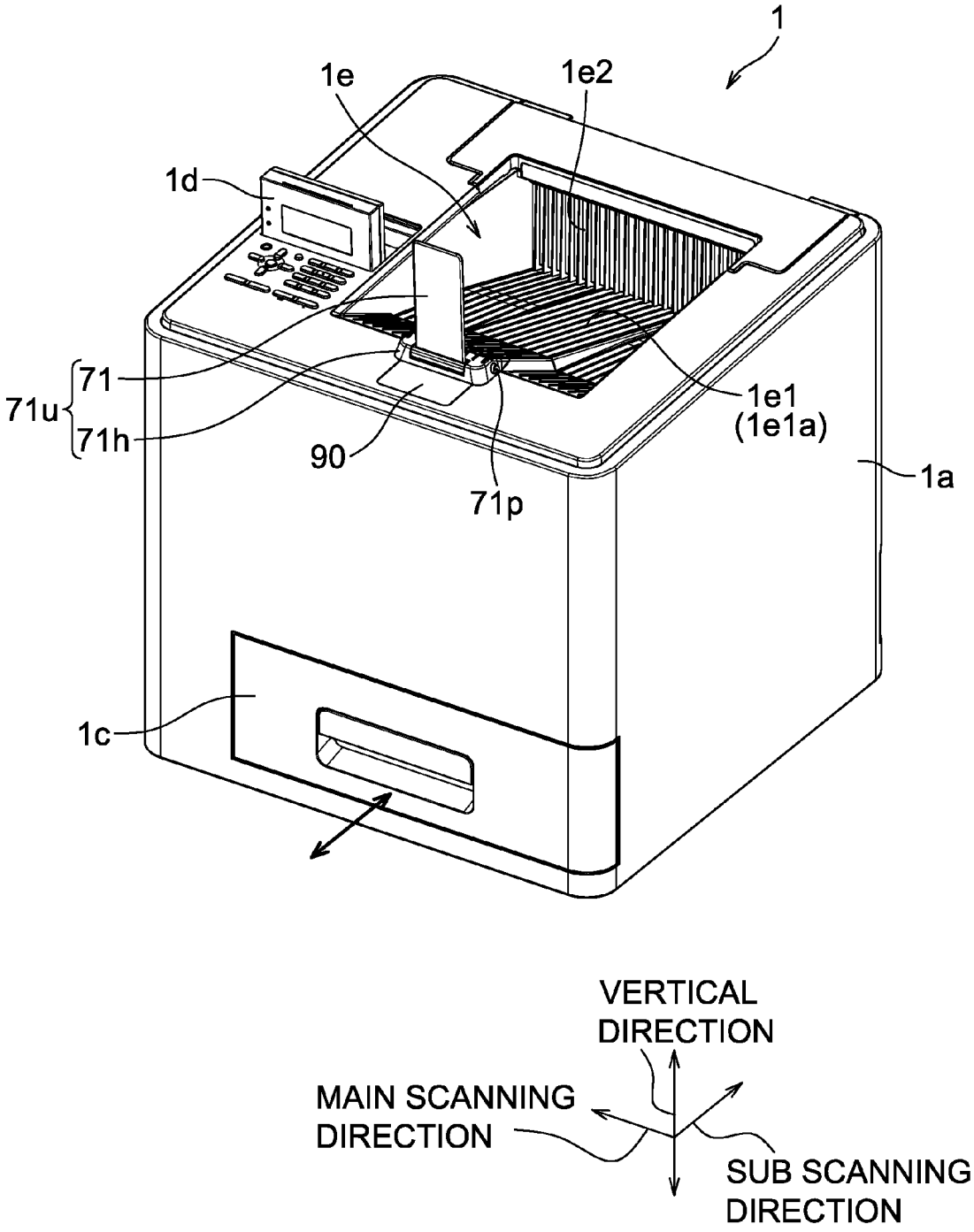
FIG. 1 is an exterior, perspective view of an inkjet printer according to embodiments of the present invention.

Hereinafter, embodiments of the invention now are described with reference to the accompanying drawings; like reference numerals are used to identify similar elements.

Figure 2:
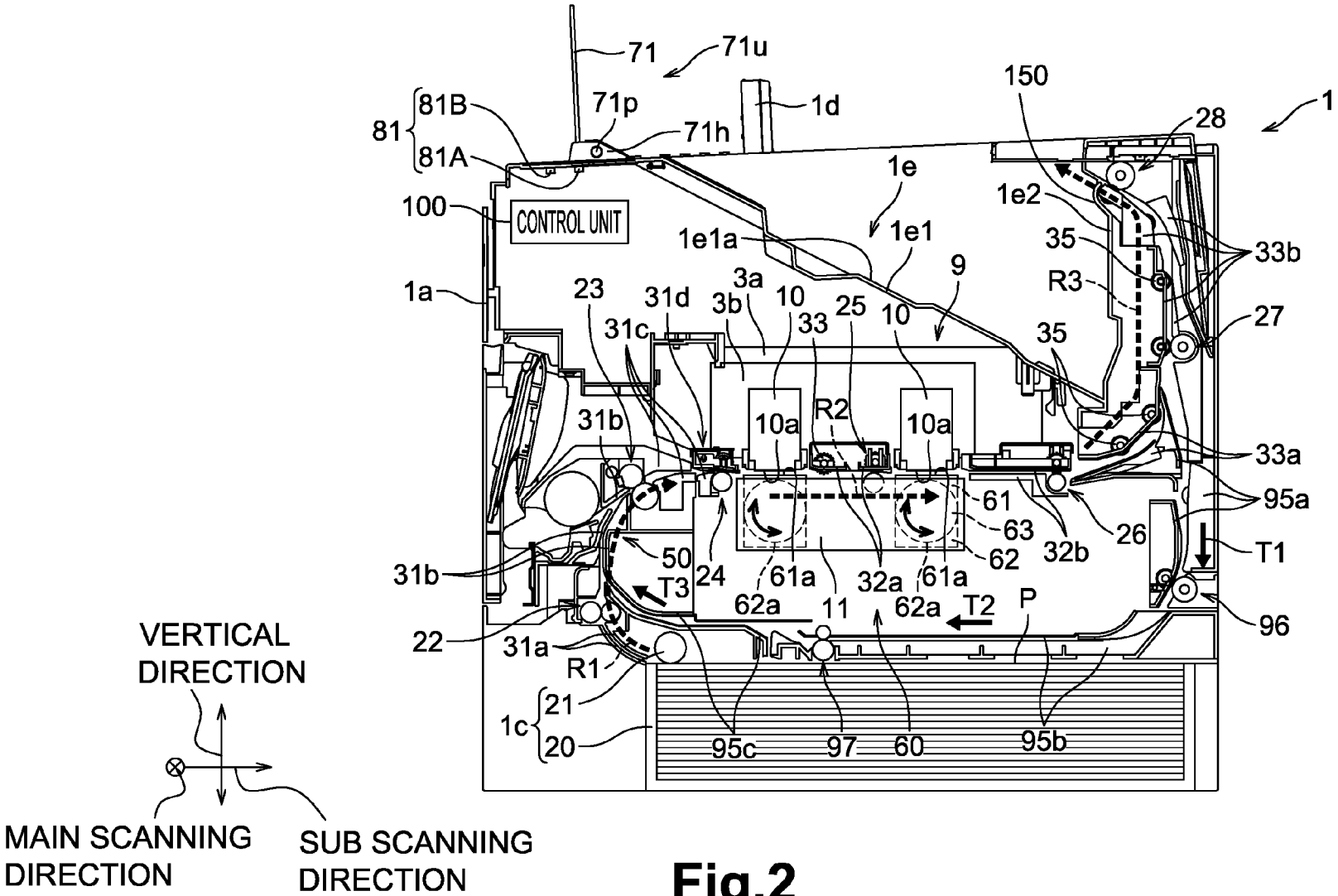
FIG. 2 is a schematic, cross-sectional view of the inkjet printer depicted in FIG. 1.

A configuration of an inkjet printer 1 according to embodiments of the present invention now is described, with reference to FIGS. 1 and 2.

The inkjet printer 1 may comprise a rectangular, parallelepiped-shaped housing 1*a*. An upper portion of the housing 1*a* may comprise a holding portion 1*e* and a display 1*d*. The display 1*d* may comprise by a liquid crystal display and other components. The holding portion 1*e* and the display 1*d* may be exposed to facilitate viewing thereof. An internal space of the inkjet printer 1 may be defined by the housing 1*a*. As depicted by arrow heads trailed by bold dashed lines in FIG.

2, a conveying path may be formed in the internal space defined by the housing 1*a* (e.g., the internal space of the inkjet printer 1), along which a paper sheet P may be conveyed in a conveying direction toward the holding portion 1*e* from the paper feed device 1*c*.

The internal space of the inkjet printer 1 and components disposed therein now are described with reference to FIG. 2.

The following components may be disposed in the internal space of the inkjet printer 1: a head device 9, which may be provided with two heads 10 configured to eject liquid; two cartridges (not depicted), each of which may correspond to one of the two heads 10; a support portion 60; a paper feed device 1*c*; a conveyance device 50, which may define the conveying path of the paper sheet P; and a control device 100, which may control components of the inkjet printer 1.

The head device 9 may comprise two heads 10, a main carriage 3*a*, and a sub-carriage 3*b*. The main carriage 3*a* and the sub-carriage 3*b* may support the heads 10. One of the heads 10 may be a precoating head, which may eject pretreatment liquid, and the other head may be an inkjet head, which may eject black ink. The precoating head may be disposed upstream of the inkjet head along the conveying direction.

The heads 10 may be substantially the same in structure and may be fixed to the sub-carriage 3*b*. For example, the heads 10 may be substantially rectangular, parallelepiped-shaped, linear heads extending in a main scanning direction, which may be a direction perpendicular to the conveying direction and a vertical direction, as depicted in FIG. 2. The heads 10 may be separated from each other in a sub-scanning direction, which may be a direction perpendicular to the main scanning direction and the vertical direction. The sub-carriage 3*b* may be supported by the housing 1*a* via the main carriage 3*a*.

A plurality of ejection ports may be formed on an ejection surface 10*a*. The ejection surface 10*a* may be disposed on a lower surface of the head 10. The head 10 may comprise liquid paths formed therein. The pretreatment liquid and black ink (hereinafter, collectively referred to as "liquid") supplied from the cartridges may flow in the liquid paths formed in the head 10 and may reach the ejection ports therethrough. For example, the pretreatment liquid may prevent ink bleeding and strike-through and improve color enhancement and dryability of the ink.

The support portion 60 may be disposed to face the ejection surfaces 10*a* of the heads 10 in the vertical direction. The support portion 60 may comprise: two rotary members 63, each facing one of the heads 10; a platen 61 and a facing member 62 fixed to a peripheral surface of each of the rotary members 63; and a frame 11, which may support rotatably the rotary members 63.

Lengths of the platen 61 and of the facing member 62 along the main scanning direction and the sub-scanning direction may be greater than lengths of the ejection surface 10*a* along the main scanning direction and the sub-scanning direction. The platen 61 and the facing member 62 may be aligned with the ejection surface 10*a* along the vertical direction, such that the platen 61 and the facing member 62 may face the ejection surface 10*a*. A surface of the platen 61 may be a support surface 61*a*, which may face the ejection surface 10*a* and may support the paper sheet P while the conveyance device 50 conveys the paper sheet P over the platen 61. A plurality of ribs may be formed in the support surface 61*a* along the sub-scanning direction. The facing member 62 may comprise a water-impermeable or substantially water-impermeable material. The facing member 62 may comprise a facing surface 62*a*, which may be smooth and may face the ejection surface 10*a*.

The rotary member 63 may rotate about an axis of rotation parallel to the main scanning direction. When the rotary member 63 rotates about the axis of rotation, the rotary member 63 may switch between a first configuration (e.g., a configuration depicted in FIG. 2) and a second configuration (not depicted). In the first configuration, the support surface 61*a* may face the ejection surfaces 10*a*, but the facing surface 62*a* may not face the ejection surface 10*a*. In the second configuration, the support surface 61*a* may not face the ejection surfaces 10*a*, but the facing surface 62*a* may face the ejection surface 10*a*. The control device 100 may control the rotary member 63 to be in the first configuration when liquid is ejected from the ejection ports against the paper sheet P to form an image thereon and to be in the second configuration when the inkjet printer 1 performs a capping process. Capping is an operation to cause an end of a cap member (not depicted), which may project downward from the peripheral portions of a lower end of each head 10, to abut the facing surface 62*a*, such that the space facing the ejection surface 10*a* is separated from the external space.

The paper feed device 1*c* may be disposed in the lowermost position of the housing 1*a*, below the head device 9 and the support portion 60. The paper feed device 1*c* may comprise a paper sheet feed tray 20 and a paper sheet feed roller 21. The paper sheet feed tray 20 may be attachable to and detachable from the housing 1*a*, along the sub-scanning direction. The paper sheet feed tray 20 is an upwardly-open, box-shaped tray that may hold paper sheets P of several sizes. The control device 100 may control a motor to rotate the paper sheet feed roller 21, and the paper sheet feed roller 21 may send out the uppermost paper sheet P in the paper sheet feed tray 20.

The conveyance device 50 may define a conveying path. The conveying path may comprise paths R1, R2, and R3, which may be associated with conveyance of a paper sheet P from the paper feed device 1*c*, and paths T1, T2, and T3, which may be associated with re-conveyance of the paper sheet P. The conveyance device 50 may comprise the following components, which may define the paths R1, R2, and R3; the paths T1, T2, and T3; and a conveying motor (not depicted).

The path R1 may be a U-shaped path in a plane perpendicular to the main scanning direction and may extend from the paper feed device 1*c* to a recording position (e.g., a position facing an ejection surface 10*a*). The path R1 may be defined by a guide 31*a*, a pair of rollers 22, a guide 31*b*, a pair of rollers 23, a guide 31*c*, a guide 31*d*, and a pair of rollers 24. These components may be arranged in the above-described order along the conveying direction.

The path R2 may pass through the recording position of each of the heads 10, and the path R2 may be defined by a guide 32*a*, a pressure roller 33, and a pair of rollers 25. These components may be disposed between the heads 10. The pressure roller 33 and the pair of rollers 25 may be arranged in the above-described order along the conveying direction.

A path R3 may be a U-shaped path in a plane perpendicular to the main scanning direction and disposed further downstream in the conveying direction, than the recording position. The path R3 may extend from a guide 32*b* to the holding portion 1*e*. The path R3 may be defined by guides 32*b*, 33*a*, and 33*b*; a pressure roller 35; and pairs of rollers 26, 27, and 28. The pairs of rollers 26, 27, and 28 may be arranged in the above-described order along conveying direction. The pair of rollers 28 may output the paper sheet P from the housing 1*a*, via the opening 150, in an output direction. For example, the output direction may be a horizontal direction (e.g., perpendicular to the vertical direction depicted in FIG. 2) or the output direction may be inclined with respect to the horizontal direction. Multiple pressure rollers 35 may be disposed along the path R3.

The path R3 may be disposed downstream from the recording position in the conveyance direction and may curve in the direction opposite to the path R1 while extending upward in substantially the vertical direction, as depicted in FIG. 3. Accordingly, based on the orientation of the inkjet printer 1 depicted in FIG. 2, the path R1 may curve to the right (e.g., the path R1 is a U-shaped path which opens to the right), whereas the path R3 may curve to the left (e.g., the path R3 is a U-shaped path which opens to the left). Thus, the paths R1, R2, and R3 may combine to form a conveyance path having an inverse S shape.

The path T1 may extend downward in the substantially vertical direction depicted in FIG. 2. The path T1 may be defined by a guide 95*a* and a pair of rollers 96. The path T2 may extend in a direction opposite to the sub-scanning direction depicted in FIG. 2, and the path T2 may be defined by a guide 95*b* and a pair of rollers 97. The path T3 may extend obliquely along the vertical direction depicted in FIG. 2 and may reach the middle of the path R1. The path T3 may be defined by a guide 95*c*.

The guides 31*a*, 31*b*, 31*c*, 31*d*, 32*a*, 32*b*, 33*a*, and 33*b* may comprise guide surfaces for guiding the paper sheet P. Each of the pairs of rollers 22, 23, 24, 25, 26, 27, and 28 and of the pairs of rollers 96 and 97 may comprise a driving roller connected to the conveying motor and a driven roller, which may be driven by the respective driving roller.

A configuration of the holding portion 1*e* now is described with reference to FIGS. 1 and 2.

The holding portion 1*e* may comprise a support member 1*e*1 and a guide member 1*e*2, as depicted in FIGS. 1 and 2.

The support member 1*e*1 may be formed by an upper wall of the housing 1*a* and may comprise a surface 1*e*1 a (e.g., a support surface) that may support the output paper sheet P. The support surface 1*e*1 a may incline downward with respect to the horizontal direction in a direction opposite to the output direction (e.g., toward the guide member 1*e*2).

The guide member 1*e*2 may extend in the vertical direction and in the main scanning direction, and may be disposed upstream of the support surface 1*e*1 a along the output direction. An opposite side of the guide member 1*e*2 (e.g., a side of the guide member 1*e*2 opposite to the surface of the guide member 1*e*2 that faces the support member 1*e*1) may define the path R3, as depicted in FIG. 2. In particular, the opposite side of the guide member 1*e*2 may form a part of the guides 33*a* and 33*b*.

A configuration of a stopper device 71*u* now is described with reference to FIGS. 3A-C and 4A-E.

Figure 3A:
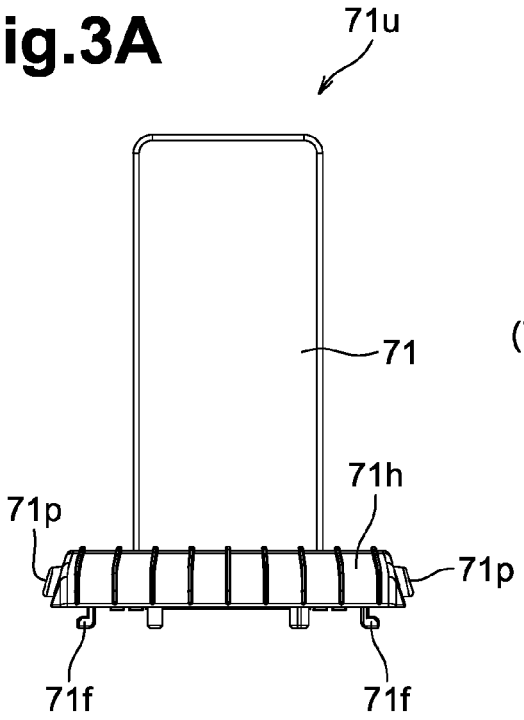
FIG. 3A is a perspective view of a stopper device of the inkjet printer of FIG. 1.

The stopper device 71*u* may comprise a plate-shaped stopper 71 and a holder 71*h* that may hold the stopper 71. The stopper device 71*u* may be disposed downstream of the support surface 1*e*1 a along the output direction. When the stopper 71 is in a standing position, as depicted in FIG. 3A, an upper end of the stopper 71 may be disposed directly above the support member 1*e*1 and above the display 1*d* in the vertical direction. For example, the upper end of the stopper 71 or at least a portion thereof may be disposed above all other components of the inkjet printer 1, as depicted in FIG. 2. The pair of rollers 28 may output the paper sheet P, and the stopper 71 may hold the paper sheet P on the support surface 1*e*1*a* to reduce instances of the inkjet printer 1 ejecting the paper sheet P out of the support surface 1*e*1*a* when the inkjet printer 1 outputs the paper sheet P at particular speeds. Thus, the pair of rollers 28 may output the paper sheet P through an output port 150 near the upper end of the guide member 1*e*2 and may eject the paper toward the stopper 71. When the stopper 71 is in the standing position, a leading end of the paper sheet P may contact the stopper 71 before landing. The stopper 71 subsequently may direct the paper sheet P to fall into the holding portion 1*e* with the leading end thereof separated from the stopper 71, such that the support surface 1*e*1*a* may support the paper sheet P and the trailing end of the paper sheet P may contact the guide member 1*e*2. The leading end of the paper sheet P may be an end of the paper sheet P disposed downstream from the trailing end of the paper sheet P along the output direction. The particular speed, at which the pair of rollers 28 may output the paper sheet P through the output port 150, may be a speed at which the inkjet printer 1 may eject the paper sheet P out of the support surface 1*e*1*a*, unless the stopper 71 is disposed on the inkjet printer 1 in the standing position.

Figure 3B:
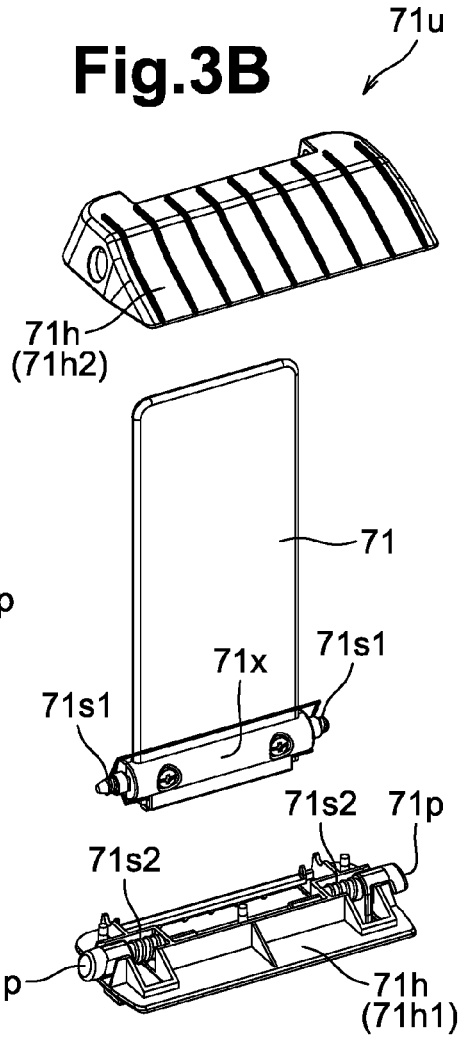
FIG. 3B is an exploded, perspective view of the stopper device.
Figure 3C:
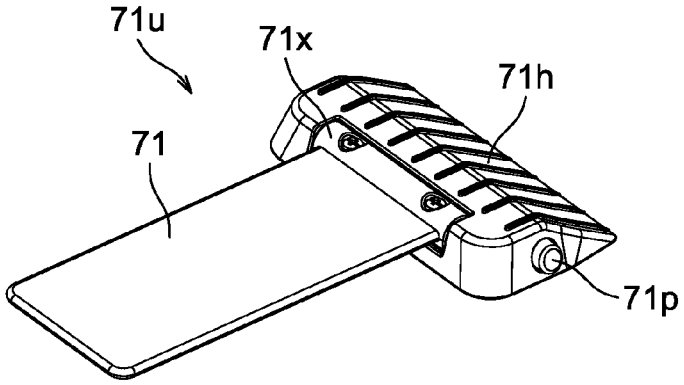
FIG. 3C is a perspective view of the stopper device depicting the stopper in a rotated configuration.

As depicted in FIGS. 3A-C, the stopper 71 is a substantially rectangular plate member. A length of the stopper 71 in a longitudinal direction of the stopper 71 (e.g., a distance from the holder 71*h* to the upper end of the stopper 71, as depicted in FIG. 3A) may correspond to the thickness of a plurality of hundreds of paper sheets P (e.g., three hundred sheets). The stopper 71 may be made of resin and may be transparent and flexible. One end of the stopper 71 along the longitudinal direction of the stopper 71 (e.g., an end opposite the upper end of the stopper 71) may comprise a shaft 71*x*, as depicted in FIG. 3B.

The holder 71*h* may comprise a base 71*h*1 and a cap 71*h*2, as depicted in FIG. 3B. The base 71*h*1 and the cap 71*h*2 may combine together with the shaft 71*x* therebetween to support rotatably the stopper 71. The stopper device 71*u* may be assembled by fitting the shaft 71*x* into a recess of the base 71*h*1 and subsequently attaching the cap 71*h*2 to the base 71*h*1.

As depicted in FIG. 3B, urging members 71*s*1, which may urge the stopper 71 into a standing or upright position, may be disposed at both ends of the shaft 71*x*. Each of the urging members 71*s*1 may be a double-torsion spring, which may comprise two coil portions and an arm portion that may connect the two coil portions. Each coil portion may use shaft 71*x* as guide bar, respectively, and the arm portion may contact stopper 71. Ends of each coil portion may be fixed rotatably to the holder 71*h*. Therefore, as depicted FIGS. 1, 2, and 3A, the stopper 71 defaults to the standing position, in which the stopper 71 stands upright from the holder 71*h* (e.g., a first position). When a user applies an external force and presses the stopper 71 against the urging force of the urging members 71*s*1 with a force greater than a predetermined threshold magnitude, the stopper 71 may rotate about the shaft 71*x* into a lay down position (e.g., a second position), as depicted in FIG. 3C. When the stopper 71 is n the lay down position, the upper end of the stopper 71 (e.g., the upper end with reference to the standing position, as described above) may be disposed at a position downstream from a lower end of the stopper 71 (e.g., an end of the stopper 71 closest to the holder 71*h*) along the output direction. By rotating the stopper 71 to the lay down position, a user may conveniently collect paper sheets P supported on the support surface 1*e*1*a*. When the user reduces or removes the external force applied the stopper 71, the position of the stopper 71 may return to the standing position from the lay down position. Thus, the stopper 71 may extend longitudinally in substantially the vertical direction in the standing position, and the stopper 71 may extend longitudinally in substantially the horizontal direction in the lay down position.

In configurations of the stopper device 71*u* that may not comprise an urging member 71*s*1 therein, the user may leave the stopper 71 in the lay down position, and the inkjet printer 1 may eject the paper sheet P out of the support surface 1*e*1*a* unless, for example, the user manually returns the stopper 71 to the standing position before using the inkjet printer. In the configurations described above, the stopper 71 may remain in the standing position unless the stopper 71 is subjected to a force greater than the predetermined threshold. Therefore, the stopper device 71*u* comprising urging members 71*s*1 therein may reduce instances of the pair of rollers 28 outputting paper sheets P through an output port 150 and ejecting the paper sheets P out of the support surface 1*e*1*a*.

In modified configurations, the stopper 71 may be flexible and may be fixed directly to the base 71*h*1, without the shaft 71*x* and the urging members 71*s*1. When the stopper 71 is subjected to a force greater than another predetermined threshold, the stopper 71 may bend into a lay down position. When the force is removed from the stopper 71, the position of the stopper 71 may return to the standing position from the lay down position.

As depicted in FIG. 3A, a pair of hooks 71*f* may be disposed on an underside of the base 71*h*1. As depicted in FIG. 3B, each of the hooks 71*f* may comprise a projection 71*p* and an urging member 71*s*2, which may urge the projection 71*p* and the hook 71*f* outward. The urging member 71*s*2 may be a compression spring, which is disposed in the holder 71*h*, such that the compression string is compressed to a length less than the free length thereof (e.g., a length when compressive forces and tensile forces are not applied in an axial direction of the spring).

Figure 4A:
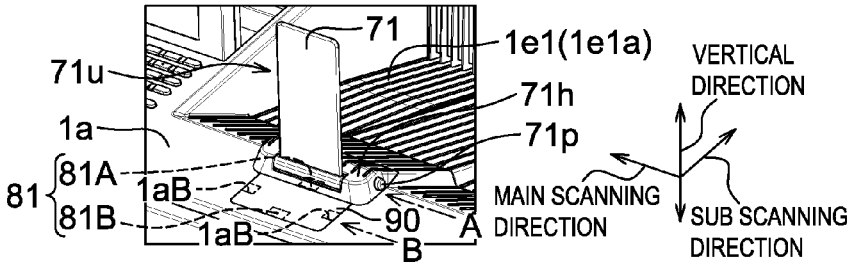
FIGS. 4A, 4B, 4C, and 4D are perspective views of the stopper device of the inkjet printer of FIG. 1 in various configurations during a process of moving the stopper device from a position for receiving DIN-A4 size recording media to a position for receiving legal size recording media.
Figure 4B:
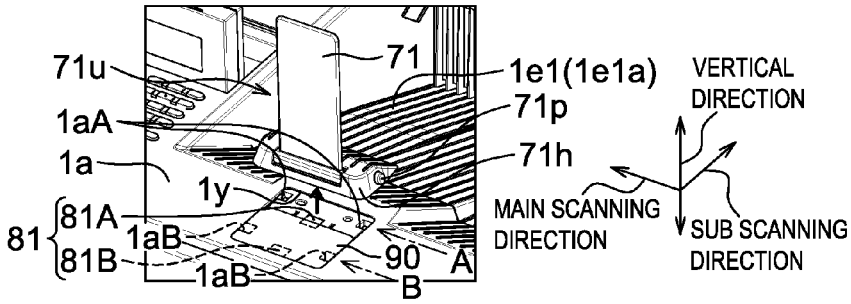
Figure 4C:
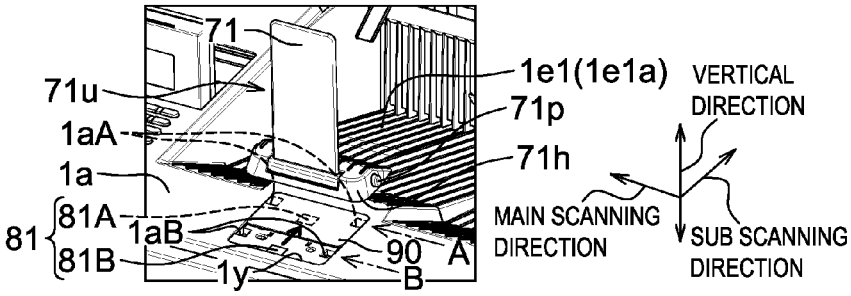
Figure 4D:
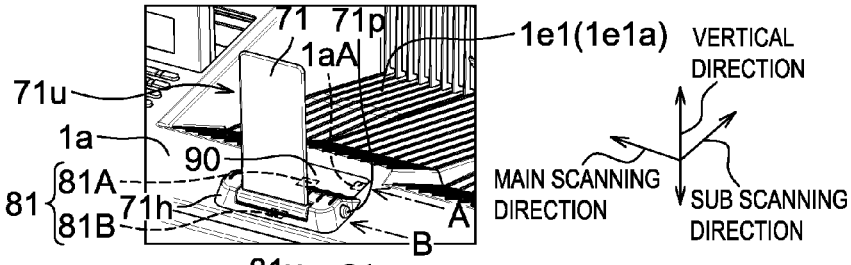
Figure 4E:
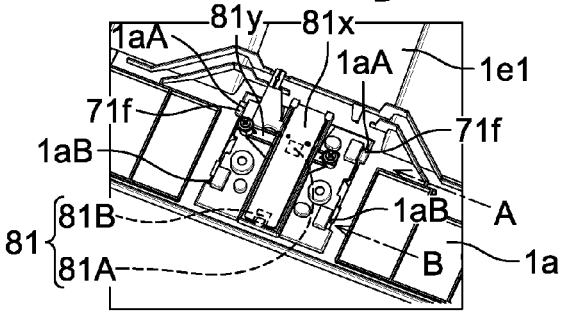
FIG. 4E is a perspective view of a light-emitting diode ("LED") substrate with a light source thereon.

The pair of hooks 71*f* may be inserted in one of a pair of holes 1*a*A and a pair of holes 1*a*B formed in an upper wall of the housing 1*a*, as depicted FIG. 4E. The stopper device 71*u* may be fixed to the housing 1*a* by inserting the pair of hooks 71*f* in one of the pair of holes 1*a*A and the pair of holes 1*a*B and by engaging the hooks 71*f* with the upper wall of the housing 1*a*, which may define the holes 1*a*A and 1*a*B therein. When the pair of projections 71*p* is pressed, such that the projections 71*p* move closer to each other against the urging force of the urging member 71*s*2, the hooks 71*f* also may move in a same direction as the projections 71*p*. Thus the hooks 71*f* may be removed from the holes 1*a*A and the holes 1*a*B, and the stopper device 71*u* may be removed from the housing 1*a*.

Configurations of components associated with the stopper device 71*u* during a process of moving the stopper device 71*u* from a position A for a DIN-A4 size paper sheet to a position B for a legal size paper sheet now are described with reference to FIGS. 4A, 4B, 4C, 4D, and 4E.

The stopper device 71*u* may be disposed in alternate positions based on the size of the paper sheet P disposed in the paper feed device 1*c*. The stopper device 71*u* may be disposed in the position A for DIN-A4 size, as depicted in FIG. 4A. The stopper device 71*u* may be disposed in the position B for legal size, as depicted in FIG. 4D. The stopper device 71*u* may be disposed in the position A when the inkjet printer 1 records on a paper sheet P of DIN-A4 size (210 mm×297 mm). The stopper device 71*u* may be disposed in the position B when the inkjet printer 1 records on a paper sheet P of legal size (215.9 mm×279.4 mm). When the stopper device 71*u* is in either of the positions A or B, the distance between the stopper 71 and an end of the support surface 1*e*1*a*, which may be an end closest to the guide member 1*e*2 along the output direction, may be greater than the length of the paper sheet P of the corresponding size (e.g., 297 mm in the DIN-A4 size and 279.4 mm in the legal size) by about 50 mm.

The stopper device 71*u* may affix to the housing 1*a* by disposing the holder 71*h* in a recess 1*y* formed by an upper surface of the upper wall of housing 1*a*, as depicted FIGS. 4B and 4C, and engaging the hooks 71*f* with the upper wall of the housing 1*a*, which may define the holes 1*a*A and 1*a*B therein. The recess 1*y* may be substantially rectangular in plan view (e.g., in a plane perpendicular to the vertical direction, as depicted in FIGS. 4A-D), may have substantially the same length as the holder 71*h* along the main scanning direction, and may have a length that is two or three times greater than the length of the holder 71*h* along the sub-scanning direction. The holder 71*h* and a cover 90 may be disposed in the recess 1*y*.

The cover 90 may be a substantially rectangular plate member. The cover 90 may have substantially the same length as the length of the recess 1*y* in the main scanning direction. The cover 90 may have a length in the sub-scanning direction corresponding to the difference between the length of the holder 71*h* and the length of the recess 1*y* along the sub-scanning direction. The cover 90 may slide in the sub-scanning direction (e.g., the output direction of the paper sheet P) when disposed in the recess 1*y*.

Referring to FIG. 4A, when the stopper device 71*u* is in the position A, the hooks 71*f* may be inserted in the holes 1*a*A, as depicted FIG. 4E. In this configuration, the holes 1*a*B may be covered by the cover 90. As depicted in FIG. 4B, when the stopper device 71*u* moves from the position A to the position B, the user may press the projections 71*p* to remove the hooks 71*f* from the holes 1*a*A, and the user may remove the stopper device 71*u* from the housing 1*a*. As depicted in FIG. 4C, the cover 90 subsequently may slide to the position A. Thus, the cover 90 may cover the holes 1*a*A, and the holes 1*a*B may be exposed. As depicted in FIG. 4D, the holder 71*h* may be disposed in the previous position of the cover 90. The hooks 71*f* may be inserted in the holes 1*a*B, and the stopper device 71*u* may affix to the housing 1*a* in the position B.

A light source 81, which may light the stopper 71, now is described with reference to FIGS. 4A, 4B, 4C, 4D, and 4E.

As depicted in FIG. 4E, a light-emitting diode ("LED") substrate 81*x* may be attached to an underside of the upper wall of the housing 1*a* via a frame 81*y*, such that the LED substrate 81*x* may face the recess 1*y*. The LED substrate 81*x* may comprise a light source 81, which may comprise separate light sources 81A and 81B. Each of the separate light sources 81A and 81B may be a LED. The LED substrate 81*x* may affix to the frame 81*y*. The LED substrate 81*x* may affix to the housing 1*a* by fixing the frame 81*y* to the underside of the upper wall of the housing 1*a* with screws, adhesive, or the like.

The separate light source 81A may be disposed to face the stopper device 71*u* when the stopper device 71*u* is in the position A, and the separate light source 81B may be disposed to face the stopper device 71*u* when the stopper device 71*u* is in the position B. When the stopper device 71*u* is in the position A, the separate light source 81A may face the stopper 71, and the separate light source 81B may face the cover 90, rather than the stopper 71, as depicted in FIG. 4A. In particular, when the stopper device 71*u* is in the position A and in the standing position, the separate light source 81A may be disposed on an extension line of the stopper 71. The extension line may extend in substantially the vertical direction through the stopper 71. Therefore, the separate light source 81A may emit light that may be oriented toward the stopper 71. In this configuration, the cover 90 may cover the separate light source 81B. When the stopper device 71*u* is in the position B, the separate light source 81B may face the stopper, and the separate light source 81A may face the cover 90, rather than the stopper 71, as depicted in FIG. 4D. In particular, when the stopper device 71*u* is in the position B and in the standing position, the separate light source 81B may be disposed on the extension line of the stopper 71. Therefore, the separate light source 81B may emit light that may be oriented toward the stopper 71. In this configuration, the cover 90 may cover the separate light source 81A.

Light emitted by the portion of light source 81 that is disposed to face the stopper 71 (e.g., one of the separate light sources 81A and 81B) may illuminate the stopper 71. The manner of lighting the stopper 71 may depend on certain properties of the stopper 71, comprising, for example, light transmittance, surface roughness, haze (e.g., a ratio of luminous diffuse transmittance to total light transmittance), and the like. The stopper 71 may be made of transparent resin. Transparent resin may have light transmittance greater than or equal to 80%; however, when the stopper 71 has a low surface roughness, light may transmit therethrough and only the periphery of the stopper 71 (e.g., the upper end and longitudinal sides) may illuminate. In certain modifications, the surface roughness of the stopper 71 may be increased by texturing (e.g., graining) the surface of the stopper 71. Therefore, light may diffuse on the surface of the stopper 71, and the entire surface of the stopper 71 may illuminate.

Figure 5:
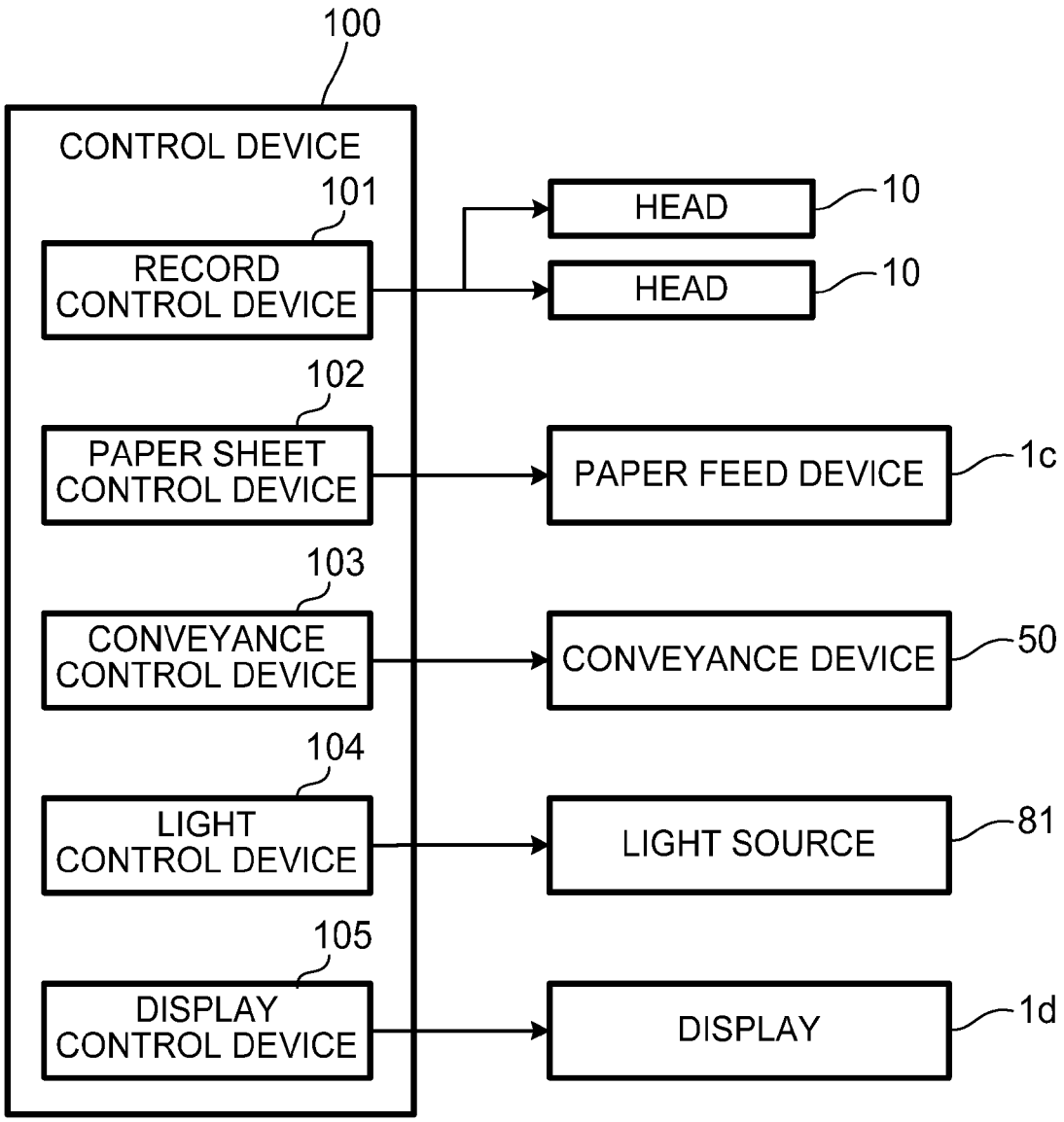
FIG. 5 is a block diagram depicting an electrical configuration of the inkjet printer of FIG. 1.

A configuration of the control device 100 and the components of the inkjet printer 1, which the control device 100 controls, now are described with reference to FIG. 5.

The control device 100 may comprise, for example, read only memory ("ROM"), random access memory ("RAM"), an interface ("I/F"), an input/output port ("I/O"), and a central processing unit ("CPU"), which is a processor. The ROM may store therein programs that the CPU may execute, various kinds of fixed data, and other information. Data (e.g., image data) used during the execution of the programs temporarily may be stored in the RAM. In application specific integrated circuits ("ASICs"), rewriting and rearrangement of image data (e.g., signal processing and image processing), as well as other processes, may be performed. The I/F may perform data transmission and reception with external devices (e.g., a PC connected to the inkjet printer 1). The I/O may perform input and output of detection signals detected by various sensors. In the control device 100, software, such as a program stored in the ROM, and hardware, such as the CPU, may cooperate to implement functions of a record control device 101, a paper sheet control device 102, a conveyance control device 103, a light control device 104, a display control device 105, and other devices.

The record control device 101 may control the heads 10 to eject liquid toward the paper sheet P in accordance with image data. The paper sheet control device 102 may control a driving motor of the paper sheet feed roller 21 to output the paper sheet P held in the paper sheet feed tray 20. The conveyance control device 103 may control a conveying motor of the conveyance device 50 to convey the paper sheet P along the conveying path.

The record control device 101, the paper sheet control device 102, and the conveyance control device 103 may control each component in tandem, while synchronizing conveyance of the paper sheet P and ejection of liquid from the heads 10. In particular, the conveyance control device 103 may convey the paper sheet P, which the paper sheet control device 102 may send out from the paper sheet feed tray 20, along the path R1 and then the path R2. When the paper sheet P supported by the support surface 61*a* passes a position directly below the heads 10 (e.g., a recording position) along the path R2, the control device 101 may drive each head 10. Liquid may eject from ejection ports of the ejection surface 10*a* onto the paper sheet P, such that the inkjet printer 1 may form an image on the paper sheet P. In a single-sided recording operation, the pair of rollers 28 subsequently may output the paper sheet P to the holding portion 1*e*. In a double-sided recording operation, the paper sheet P may not be output to the holding portion 1*e*, but instead, may return for conveyance along the paths T1, T2, and T3. The paper sheet P subsequently may be sent into the middle of the path R1 and may be conveyed along the paths R2 and R3 again. After heads 10 form an image on the reverse side, the pair of rollers 28 may output the paper sheet P to the holding portion 1*e*.

The light control device 104 may control the light source 81 to emit light in one emission mode, which may be selected from among multiple emission modes, based on a status of the inkjet printer 1. In particular, the light control device 104 may control the light source 81, such that both the separate light sources 81A and 81B may illuminate green when the inkjet printer 1 is in a normal status, which may be associated with, for example, error-free operations; and both the separate light sources 81A and 81B may illuminate orange when the inkjet printer 1 is in an error status, which may be associated with, for example, jamming (e.g., jamming of paper sheet P in the conveying path).

When the stopper device 71*u* is in the position A, the stopper 71 may illuminate in the same manner as the separate light source 81A (e.g., with a green or orange light source), based on the emission mode of the light source 81. The separate light source 81B may illuminate in the same manner as the separate light source 81A (e.g., with a green or orange light source), based on the emission mode of the light source 81. Because the cover 90 may cover the separate light source 81B in the position A, light emitted by the separate light source 81B may not illuminate the stopper 71 and may not leak out of the recess 1*y*.

Similarly, when the stopper device 71*u* is in the position B, the stopper 71 may illuminate in the same manner as the separate light source 81B (e.g., with a green or orange light source), based on the emission mode of the light source 81. The separate light source 81A may illuminate in the same manner as the separate light source 81B (e.g., with a green or orange light source), based on the emission mode of the light source 81. Because the cover 90 may cover the separate light source 81A in the position B, light emitted by the separate light source 81A may not illuminate the stopper 71 and may not leak out of the recess 1*y*.

The display control device 105 may control the display 1*d* to display information in a display mode selected from among a plurality of display modes, based on the status of the inkjet printer 1. In particular, the display control device 105 may control the display 1*d* to display recording state information (e.g., size of the paper sheet P and the number of paper sheet P) before recording. The display control device 105 may control the display 1*d* to display a preview of an image that the inkjet printer may record when the inkjet printer 1 is in the normal status. The display control device 105 controls the display 1*d* to display a message indicating an error (e.g., "paper jam; remove paper") when the inkjet printer 1 is in the error status.

As described above, the stopper 71 in the standing position, as depicted in FIGS. 1 and 2, may illuminate differently, based on the status of the inkjet printer 1. This may facilitate viewing the light and determining the status of the inkjet printer 1. The upper end of the stopper 71 may be disposed above all or many of the other components of the inkjet printer 1. This may facilitate viewing the light from positions around the inkjet printer 1, without interference or with reduced interference.

The stopper device 71*u* may be disposed in one of the positions A and B along the output direction in accordance with the size of the paper sheet P, as depicted in FIGS. 4A-D. Therefore, paper sheets P of several sizes (e.g., two) may be used in inkjet printer 1. When the stopper device 71*u* is in the position A, the separate light source 81B may be covered by the cover 90. When the stopper device 71*u* is in the position B, the separate light source 81A may be covered by the cover 90. Therefore, the light emitted by the covered one of the separate light sources 81B and 81A may not illuminate the stopper 71 and may not leak out of the recess 1*y*. The light emitted by the one of the separate light sources 81A and 81B, which are disposed underneath the stopper 71 may illuminate the stopper 71. This may reduce confusion associated with the position of the stopper device 71*u*, in accordance with the position of the stopper device 71*u*. When the light is emitted by one of the separate light sources 81B and 81A that is not disposed underneath the stopper 71, the stopper device 71*u* may appear to be in a position different from the actual position of the stopper device 71*u*. In particular, for example, when the size of paper sheet P is DIN-A4, the stopper device 71*u* may be disposed in the position A. When the light emitted by the separate light source 81B leaks out, the stopper device 71*u* may appear to be disposed in the position B, and the position of the stopper device 71*u* may be checked unnecessarily, which may be inefficient and waste time. Substantially the same problem may arise when the paper sheet P is of legal size, the stopper device is disposed in position B, and the light emitted by the separate light source 81A leaks out. In the configuration described above, however, the light emitted by the separate light source 81B or 81A may not leak out because of the cover 90. Thus, the above-described configuration may reduce instances of incorrectly recognizing the position of the stopper device 71*u*.

The light source 81 may comprise the separate light sources 81A and 81B, which may be disposed in positions corresponding to the positions A and B. The cover 90 may be slidable in the sub-scanning direction (e.g., the output direction of the paper sheet P) to cover the one of the separate light sources 81A and 81B that is not at a position corresponding to the position of the stopper device 71*u*. In the above-described configuration, the light emitted by one of the separate light sources 81A and 81B may illuminate the stopper 71 by sliding the cover 90 to another position.

The holding portion 1*e* may be disposed on the upper surface of the upper wall of the housing 1*a*, as depicted in FIG. 1. The above-described configuration may facilitate viewing the light exiting the stopper 71 and may facilitate a determination of the state of the inkjet printer 1.

The upper end of the stopper 71 (e.g., the upper end of the stopper 71 in the standing position) may be disposed above the display 1*d*, as depicted in FIG. 1. The above-described configuration may facilitate viewing the light exiting the stopper 71 and may facilitate a determination of the state of the inkjet printer 1.

The light control device 104 may control the light source 81 in cooperation with the control of the display 1*d* by the display control device 105. In particular, the display control device 105 may control the display 1*d* to display a message indicating the error status (e.g., "paper jam; remove"). The light control device 104 may control the light source 81, such that both of the separate light sources 81A and 81B emit orange light. In the configuration described above, the status of the inkjet printer 1 readily may be checked by observing the stopper 71 and the display 1*d*. The stopper 71 may be in the standing position unless the stopper is forced into the lay down position. Thus, the stopper 71 may be in the standing position when the user is away from the inkjet printer 1 and the light exiting the stopper may notify the user of the status of the inkjet printer 1 from a distance. It may be important for the user to know the error status of the inkjet printer 1, and, thus, the inkjet printer 1 readily may notify the user of the error status by emitting light through the stopper 71 in the standing position.

The stopper 71 may be disposed at the front side (e.g., the front left side of FIG. 1) of the inkjet printer 1. A display surface of the display 1*d* may be oriented toward the front side of the inkjet printer 1, as depicted in FIG. 1. The inkjet printer 1 may comprise an opening formed at the front side thereof, through which the paper sheet feed tray 20 is attached to the housing 1*a*. The front side of the inkjet printer 1 may be an upstream side along a direction in which the paper sheet feed tray 20 may be attached to the housing 1*a*, as depicted by the double-ended arrow in FIG. 1. In the configuration described above, the stopper 71 may be disposed in front of the inkjet printer 1, and the light exiting the stopper 71 may be viewed conveniently and the status of the inkjet printer 1 also may be checked conveniently.

The stopper 71 may be flexible. In the configuration described above, even when excessive force (e.g., impact load by the paper sheet P abutting the stopper 71 and the force applied by the user) is applied to the stopper 71, the force may be absorbed by the flexible stopper 71 and instances of damage to the stopper 71 may be reduced.

An inkjet printer according to certain embodiments of the invention now is described with reference to FIGS. 6 and 7.

Figure 6:
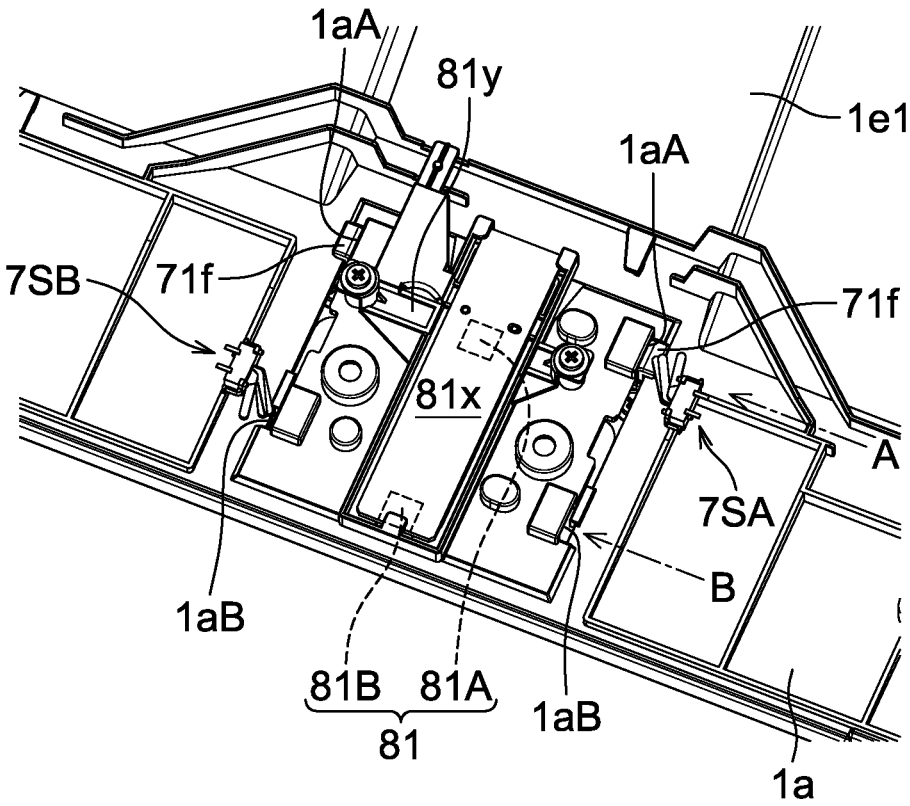
FIG. 6 is an enlarged perspective view substantially similar to FIG. 4E and depicting a sensor configured to output a signal based on a position of a stopper device in an inkjet printer according to certain embodiments of the invention.

According to FIG. 6, the inkjet printer may have substantially the same configuration as that of the inkjet printer 1, as depicted in FIG. 1, except that the inkjet printer, as depicted in FIG. 6, may comprise sensors 7SA and 7SB, which may output a signal relative to a position of the stopper device 71*u*, and that the light control device 104 may control the light source 81 in accordance with the signal output by the sensors 7SA and 7SB.

The sensors 7SA and 7SB may be disposed to correspond to the positions A and B, respectively, as depicted in FIG. 6. The sensors 7SA and 7SB may be flat spring sensors and may bend when contacting the hook 71*f* of the stopper device 71*u*. The sensors 7SA and 7SB may output an ON signal to the light control device 104 when the flat spring is bent, and the sensors 7SA and 7SB may output an OFF signal to the light control device 104 when the flat spring is not bent.

As depicted in FIG. 6, the sensor 7SA may contact the hook 71*f*, may bend, and may output an ON signal to the light control device 104 when the stopper device 71*u* is in the position A. In this configuration, the sensor 7SB may not bend and may output an OFF signal to the light control device 104. The sensor 7SB may contact the hook 71*f*, may bend, and may output an ON signal to the light control device 104 when the stopper device 71*u* is in the position B. In this configuration, the sensor 7SA may not bend and may output an OFF signal to the light control device 104.

The light control device 104 may control the light source 81 in accordance with signals received from the sensors 7SA and 7SB. In particular, when the sensor 7SA outputs an ON signal and the sensor 7SB outputs an OFF signal (e.g., when the stopper device 71*u* is in the position A), light control device 104 may control the light source 81, such that the separate light source 81A may emit light and the separate light source 81B may not emit light. When the sensor 7SA outputs an OFF signal and the sensor 7SB outputs an ON signal (e.g., when the stopper device 71*u* is in the position B), light control device 104 may control the light source 81, such that the separate light source 81B may emit light, and the separate light source 81A may not emit light.

Figure 7:
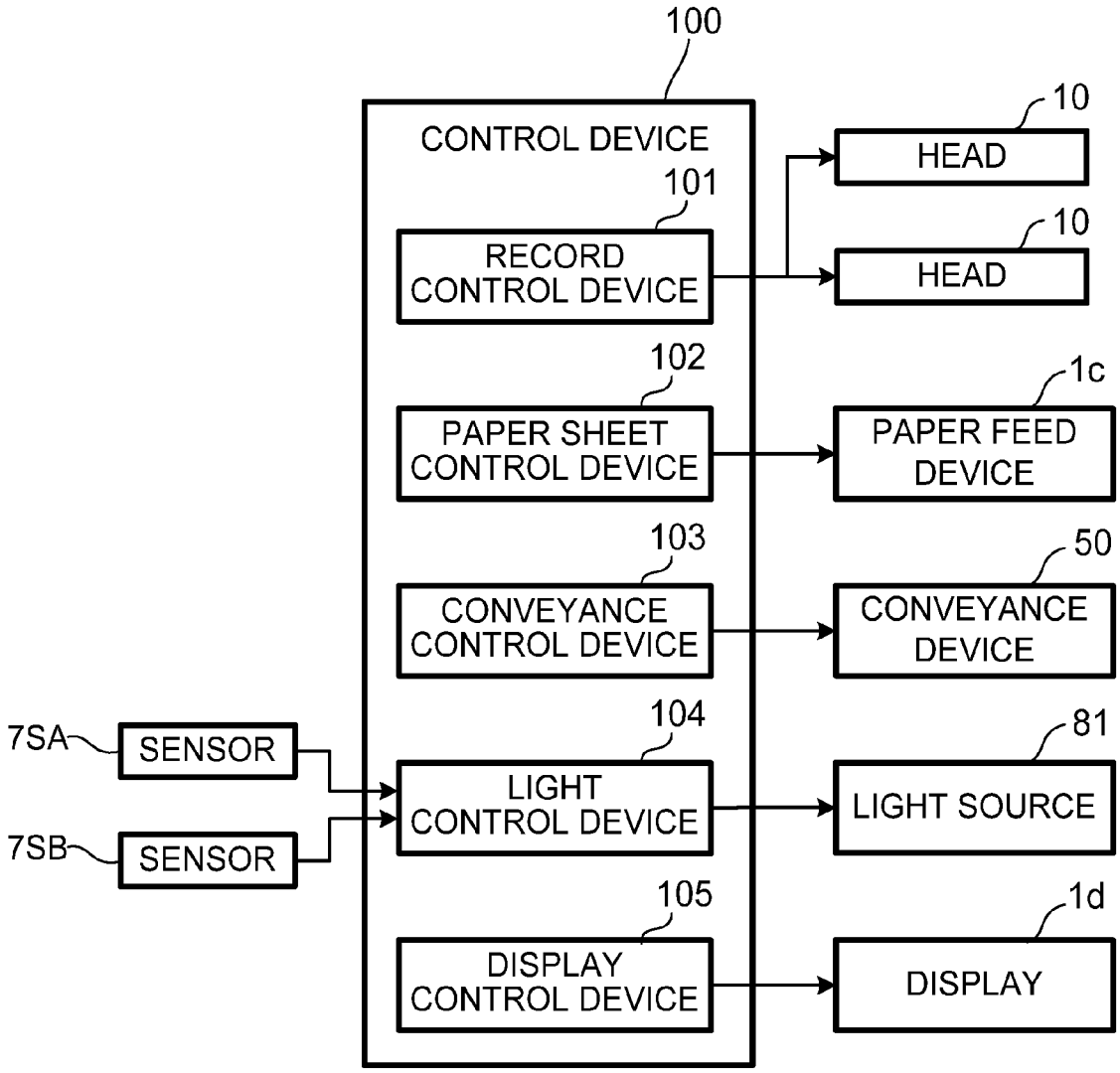
FIG. 7 is a block diagram depicting an electrical configuration of the inkjet printer of FIG. 6.
Figure 8A:
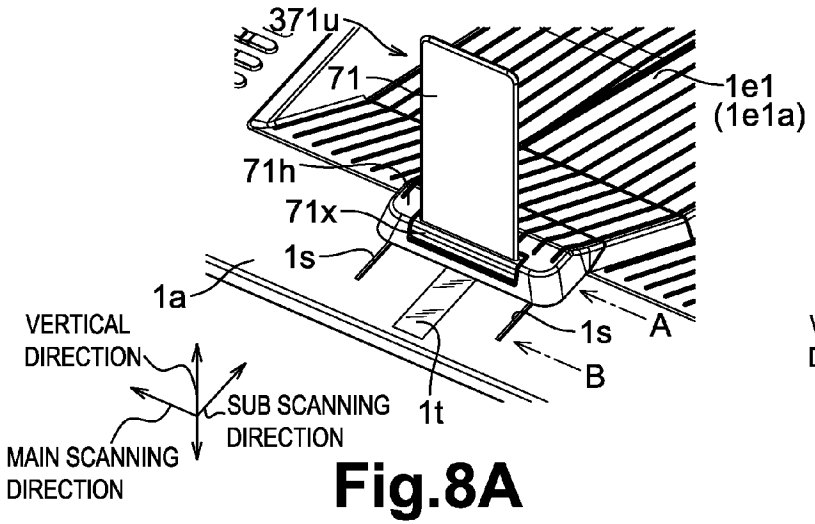
FIGS. 8A and 8B are perspective, top views of a stopper device of an inkjet printer according to particular embodiments in various configurations during a process of sliding the stopper device together with a light source.
Figure 8B:
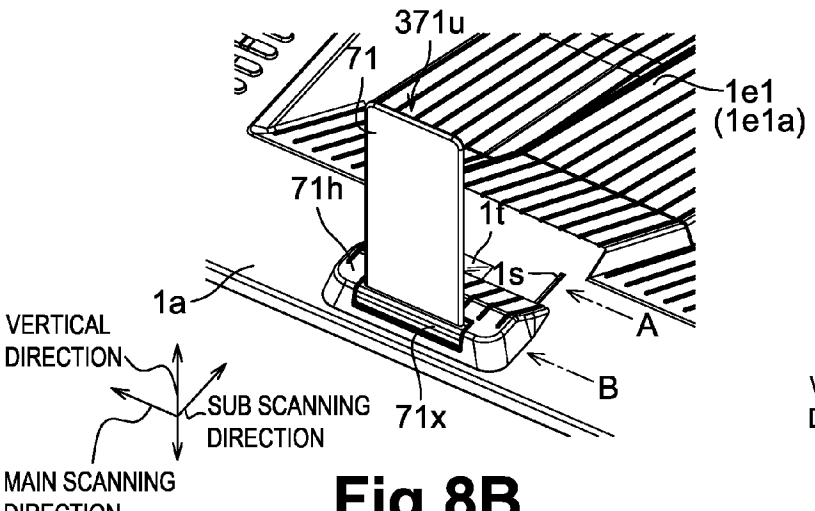
Figure 8C:
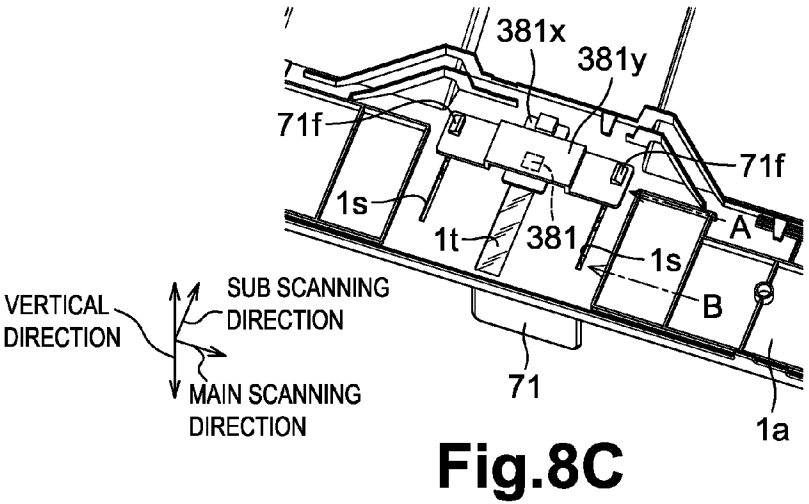
FIGS. 8C and 8D are perspective, bottom views of the stopper device depicted in FIGS. 8A and 8B in the respective configurations depicted in FIGS. 8A and 8B.
Figure 8D:
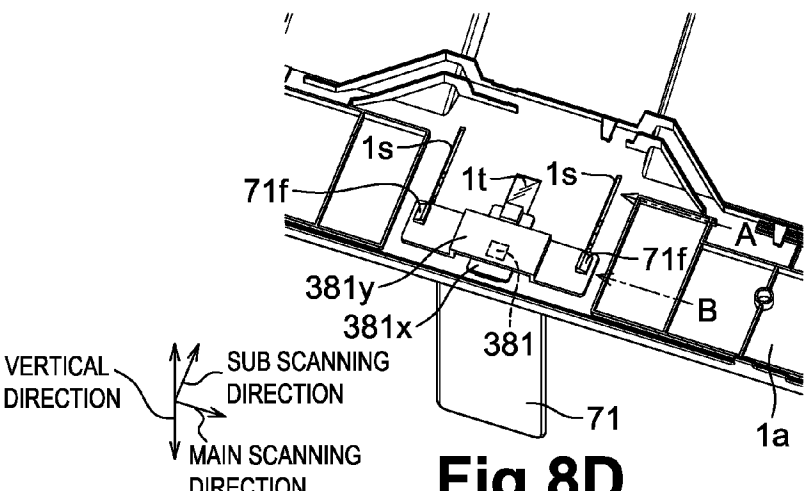

The embodiments of FIGS. 6 and 7 may reduce energy consumption compared with a configuration in which both the separate light sources 81A and 81B may emit light all of the time.

An inkjet printer according to particular embodiments of the invention now is described with reference to FIGS. 8A-D.

The inkjet printer, as depicted in FIGS. 8A-D, may have substantially the same configuration as that of the inkjet printer 1, as depicted in FIG. 1, except that the configuration of the stopper device may be different. In the inkjet printer of FIGS. 8A-D, there may be only one light source, rather than two light sources, and there may be no cover corresponding to cover 90. Unlike the embodiments of FIG. 1, a stopper device may be configured, such that a LED substrate, comprising a light source, may be attached to the stopper device, rather than to the housing.

A stopper device 371*u* according to FIGS. 8A-D may differ from the stopper device 71*u* of FIG. 1 because the stopper device 371*u* may not comprise a projection 71*p* and an urging member 71*s*2, and a LED substrate 381*x* may be attached to the opposite side of a bottom of a holder 71*h* via a frame 381*y*. The LED substrate 381*x* may comprise a single light source 381. The LED substrate 381*x* may affix to the frame 381*y*, and the LED substrate 381*x* may be fixed to the holder 71*h* by engaging the frame 381*y* with the hook 71*f*.

Instead of the recess 1*y* depicted FIGS. 4B and 4C, the housing 1*a* according to FIGS. 8A-D may comprise a pair of slits 1*s* and a light transmission device 1*t*, which may be made from a transparent plate or other materials and which may be disposed between the slits. The slits 1*s* and the light transmission device 1*t* may extend along the sub-scanning direction. The holes 1*a*A and 1*a*B depicted in FIGS. 4A-4E may not be formed in the housing 1*a* according to FIGS. 8A-D.

The frame 381*y* may face the holder 71*h*, via the LED substrate 381*x*, and the upper wall of the housing 1*a*. The light source 381 may be disposed to face the light transmission device 1*t*. Light emitted by the light source 381 may transmit through the light transmission device 1*t*, and the stopper 71 may illuminate.

The stopper device 371*u* may be slidable along the slit 1*s* in the sub-scanning direction when the hook 71*f* is inserted in the slit 1*s*. Therefore, the stopper device 371*u* may be disposed in the position A and in the position B. In this configuration, the light source 381 may move with the stopper 71 because the light source 381 may be fixed to the stopper 71.

According to FIGS. 8A-D, the light emitted by the light source 381 may illuminate the stopper 71 when the stopper 71 is in either one of the position A and the position B, without using the cover 90, according to the embodiments of FIG. 1, or without using the sensors 7SA and 7SB to activate the light control device 104, according to embodiments of FIG. 6.

An inkjet printer 401 according to other embodiments of the invention now is described with reference to FIGS. 9 and 10.

Figure 9:
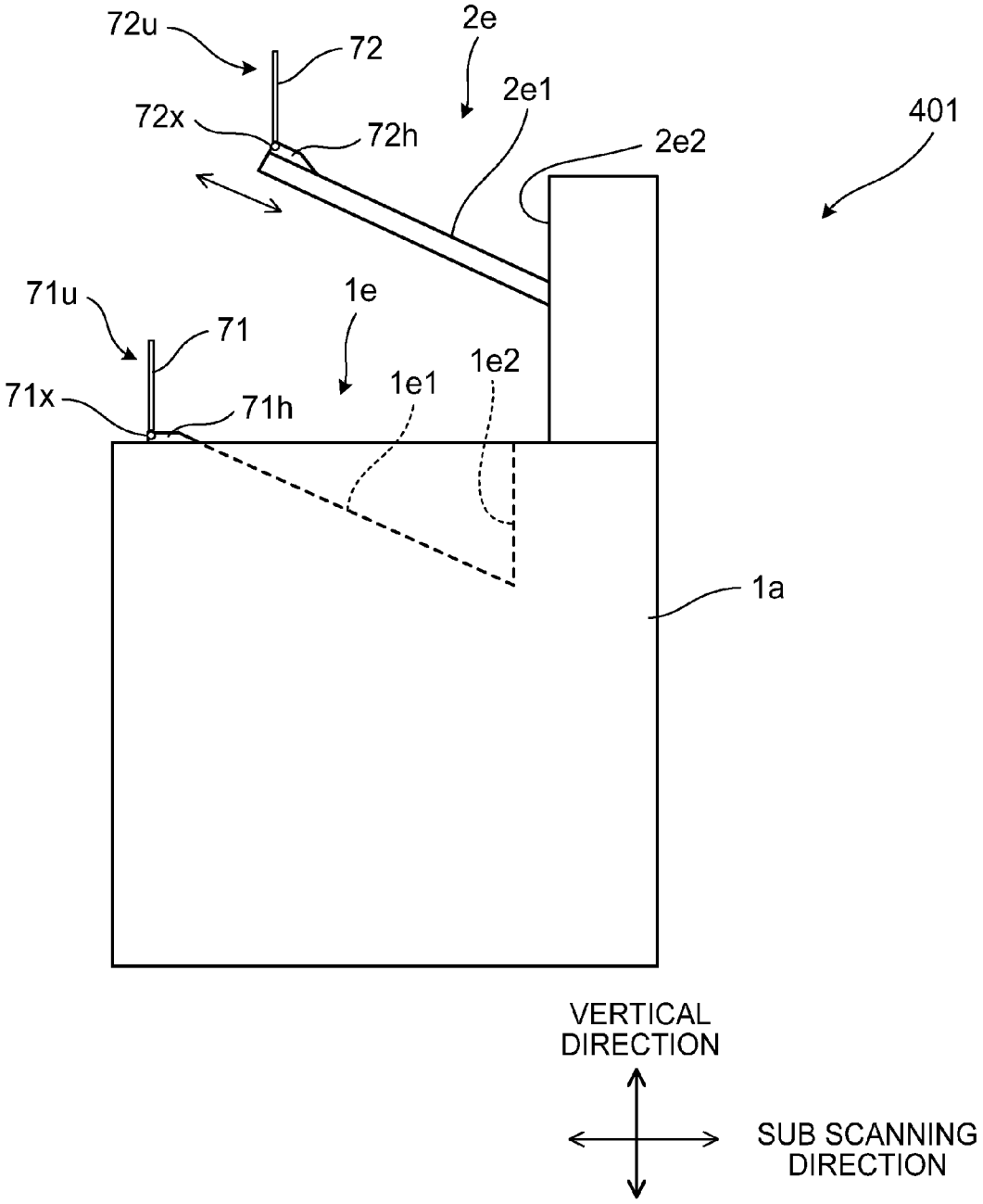
FIG. 9 is an exterior, perspective view of an inkjet printer according to other embodiments of the invention.
Figure 10:
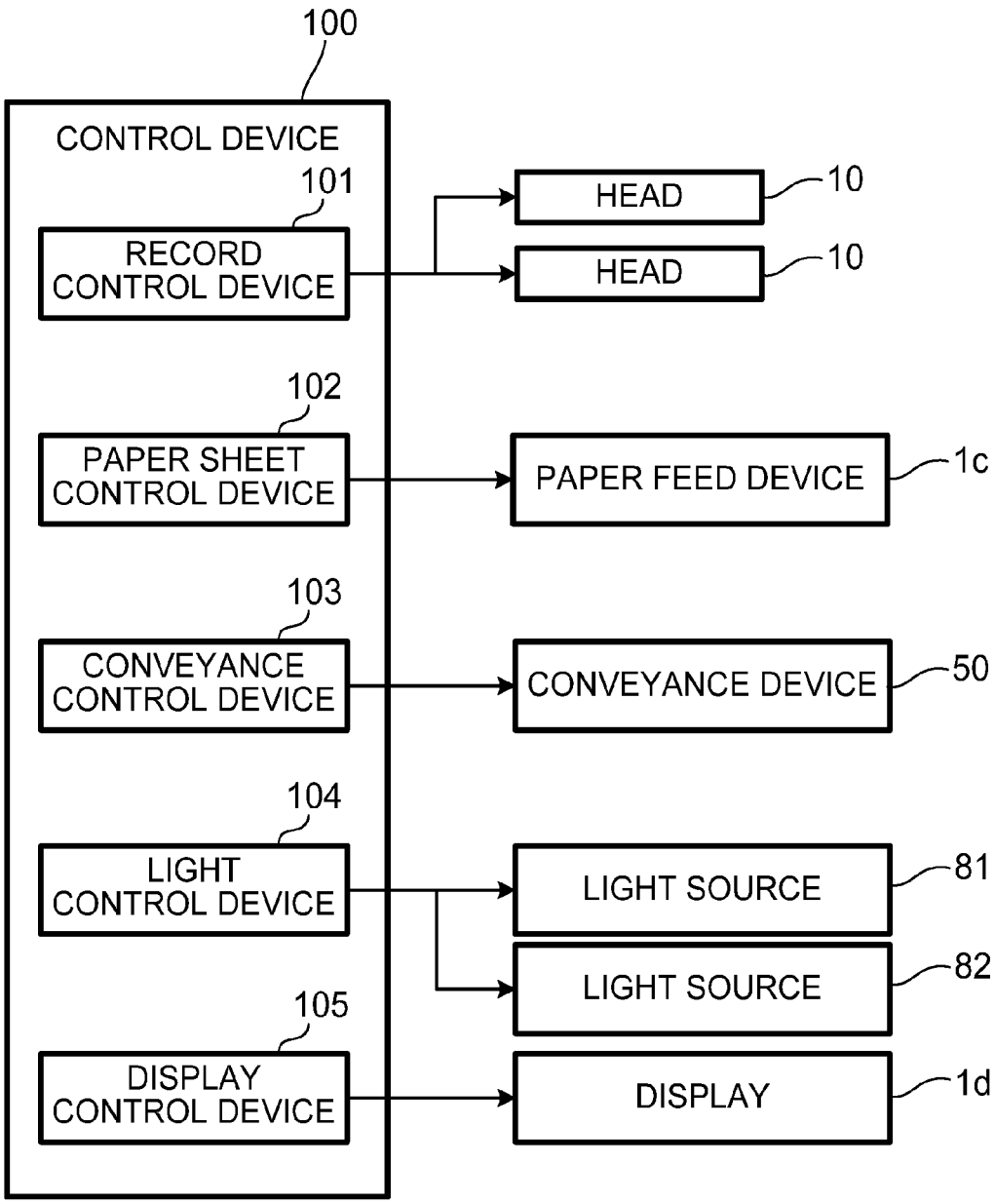
FIG. 10 is a block diagram depicting an electrical configuration of the inkjet printer of FIG. 9.

The inkjet printer 401 according to FIGS. 9 and 10 may have substantially the same configuration as that of the inkjet printer 1 according to the first embodiment, except for an additional holding portion 2*e*, which may be attached removably. The additional holding portion 2*e* may affix to a back surface of an upper portion of the housing 1*a*, as depicted in FIG. 9. The additional holding portion 2*e* may comprise substantially the same components as the holding portion 1*e*, such as a support member 2*e*1, which may be substantially the same as the support member 1*e*1; a guide member 2*e*2, which may be substantially the same as the guide member 1*e*2; and a stopper device 72*u*, which may be substantially the same as the stopper device 71*u*.

The stopper device 72*u* may comprise a plate-shaped stopper 72, which may be substantially the same as the stopper 71 and a holder 72*h* that may support rotatably the stopper 72 via a shaft 72*x* of the stopper 72. The holder 72*h* may be slidable against an extending portion (the extending portion may be covered by the holder 72*h* and is not depicted in FIG. 9 for this reason), which may extend from a downstream end of the support member 2*e*1 in the output direction. The stopper device 72*u* may not be removable, but instead, may be slidable in the output direction. The stopper device 72*u* may be disposed at a position for DIN-A4 size recording media, as depicted in FIG. 9. The holder 72*h* may be drawn (e.g., slid) along the path indicated by the double-headed arrow in FIG. 9 toward the left side of FIG. 9 to change from the position for DIN-A4 size recording media to a position for legal size recording media.

As depicted in the block diagram of FIG. 10, a light source 82, may illuminate the stopper 72 and may be disposed near the shaft 72*x* in the holder 72*h*. The light source 82 may affix to the stopper device 72*u* and may be slidable with the stopper device 72*u*.

According to FIGS. 9 and 10, a conveyance control device 103 may control a conveying motor of a conveyance device 50 to convey a paper sheet P along a conveying path determined by a selection or by other means. The selected conveying path may be one of a path extending from the paper feed device 1*c* to the holding portion 1*e* and a path extending from the paper feed device 1*c* to the additional holding portion 2*e*.

The light control device 104 may control the light sources 81 and 82, such that one of the stopper 71 and the stopper 72 may illuminate. The light control device 104 may select one of the light sources 81 and 82 to illuminate based on the holding portion corresponding to the selected conveying path. In particular, when the paper sheet P is output to the holding portion 1*e*, the light control device 104 may control the light sources 81A and 81B of the light source 81 to emit light, which may illuminate the stopper 71. When the paper sheet P is output to the additional holding portion 2*e*, the light control device 104 may control the light source 82 to emit light which may illuminate the stopper 72.

The embodiments according to FIGS. 9 and 10 may facilitate determining whether the paper sheet P is output to the holding portion 1*e* or to the holding portion 2*e*.

Although embodiments of the invention have been described above, the invention is not limited to these embodiments. Various design changes may be made without departing from the scope described in claims. In modifications, features of embodiments described above may be combined, replaced, improved, and eliminated.

The stopper may be made of various materials other than resin. The stopper may be formed in various shapes, such as a truncated cone shape, instead of the plate shape. The stopper may be rigid, rather than flexible. The stopper may not be transparent, as long as the light emitted by the light source may illuminate the stopper. The surface of the stopper may not be textured (e.g., grained). The stopper may not be disposed at the front of the recording apparatus, but instead, may be disposed at the side or the back of the recording apparatus. The stopper may be removable from the housing of the recording apparatus in the manner of the stopper 71. Alternatively, the stopper may be slidable against the housing of the recording apparatus in the manner of the stopper 72. The stopper may be disposed at two contact positions (e.g., the position A for DIN-A4 size and the position B for legal size as in the embodiment described above), but the stopper also may be disposed at three or more contact positions. Alternatively, the stopper may be disposed at a single contact position.

The sensor, which outputs a signal relative to the position of the stopper, is not limited to the flat spring sensors 7SA and 7SB, but instead, may be one or more of various types of sensors (e.g., a noncontact optical sensor, a magnetic sensor, and an ultrasonic sensor). The sensors may not be disposed at all of the contact positions. In some modifications, for example, the sensors may be disposed at some of the positions corresponding to a portion (e.g., the sensors may be disposed at one position) of the contact positions.

The cover may not be slidable, but instead, may be, for example, removable from the housing of the recording apparatus. The cover may be excluded in a configuration in which the light source may be controlled in accordance with a signal of a sensor, which may output the signal based on the position of the stopper.

The light source may not be a LED, but instead, may be a halogen lamp, a metal halide lamp, a high pressure mercury lamp, or another type of lamp. At least one light source may be adequate. In particular, when the stopper may be disposed in a plurality of contact positions, the light source is not limited to dispositions facing multiple contact positions, but instead, the light source may be disposed to face at least one of the contact positions. For example, a light source may be disposed to face the position A for DIN-A4 size recording media, or a light source may be disposed to face the position B for legal size recording media.

The "emission mode" of the light source may be defined by one or more of color of light, luminous intensity, speed or interval of blinking, and whether the light source is in an "ON" state or an "OFF" state. The "status of the recording apparatus" may comprise a normal status and an error status, as described in foregoing embodiments; a recording status (e.g., when the recording device currently is recording an image on the recording medium); a maintenance status (e.g., when the recording device, the conveyance device, or other components currently are under maintenance); and a recording standby status (e.g., when the recording apparatus is waiting for recording instructions). The "status of the recording apparatus" is not limited to the status of the recording apparatus itself (e.g., the normal status and the error status), but instead, may be the status of each section related to the recording apparatus (e.g., the status of conveyance of the recording medium by the conveyance device). In an example, the emission mode of the light source may change in accordance with an orientation of the recording surface and the order of recording on the recording media.

The recording apparatus may comprise one or more holding portions. When the recording apparatus comprises a plurality of holding portions, each holding portion may have a configuration which may be substantially the same as or different from those of other holding portions. The holding portion may be fixed to the recording apparatus, similar to the holding portion 1*e*, or may be removable from the recording apparatus, similar to the additional holding portion 2*e*. The holding portion is not limited to be disposed on the upper surface of the upper wall of the housing of the recording apparatus, but instead, may be disposed at the side of the housing or at other positions. The support surface may extend in one or more of a variety of directions, such as the horizontal direction.

The upper end of the stopper in the standing position may be at a position lower than or the same as a position of the display. The image on the display and the emission of light from the light source may not be in cooperation with each other. Alternatively, the display may be excluded.

The path or paths related to re-conveyance may be excluded. The pressure roller may be excluded. The recording medium may be conveyed in a belt conveyance system, instead of the roller conveyance system of foregoing embodiments. The configuration of the conveying path may be changed. In the foregoing embodiments, the paths R1, R2, and R3 associated with the normal conveyance may form an inverted S shape when combined; however, paths related to the normal conveyance may be other shapes, such as a U shape when combined.

In foregoing embodiments, a recording apparatus may be an inkjet printer comprising two recording devices, such as two heads 10, which are each configured to eject one of black ink and pretreatment liquid. In certain modified configurations, the recording apparatus may comprise more than two recording devices. In some modified configurations, one or more of the recording devices may eject color ink. In other modified configurations, one or more of the recording devices may eject liquid other than pretreatment liquid and ink. The recording apparatus may not be limited to a liquid ejection recording apparatus, such as the inkjet printer described in foregoing embodiments. In particular modified configurations, the recording apparatus may be a laser printer comprising a laser recording device and a heat transfer recording device. In the laser recording device, a laser beam or other means may irradiate a charged photoconductor to form an electrostatic image on the photoconductor. The electrostatic image may be transferred to a recording medium. In the heat transfer recording device, ink applied to a tape may be transferred to the recording medium by the application of heat.

The recording medium is not limited to the paper sheet P, but instead, may be one or more of a variety of media adapted to recording. The housing of the recording apparatus may comprise a first housing and a second housing, which may be movable (e.g., rotatable) with respect to the first housing. The invention is not limited to a printer, but instead, may be applied to other apparatus, such as facsimile machines and copiers.

While the invention has been described in connection with various exemplary structures and illustrative embodiments, it will be understood by those skilled in the art that other variations and modifications of the structures, configurations, and embodiments described above may be made without departing from the scope of the invention. For example, this application comprises any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments consistent with the scope of the claimed invention will be apparent to those skilled in the art from a consideration of the specification or practice of the invention disclosed herein. It is intended that the specification and the described examples are illustrative with the true scope of the invention being defined by the following claims.

What is claimed is:

1. A recording apparatus comprising:

a recorder configured to record an image on a recording medium at a recording position;

a conveyer configured to convey a recording medium through the recording position and to output the recording medium along an output direction;

a holder configured to hold a recording medium output by the conveyer;

a stopper disposed downstream of the holder along the output direction, wherein the stopper is configured to contact an end of a recording medium when the recording medium is output by the conveyer and the stopper is in a first position, and wherein the stopper is configured to move selectively between the first position and a second position, in which an end of the stopper is farther to the holder than when in the first position;

an urging member configured to urge the stopper to move to the first position from the second position;

a light source configured to illuminate the stopper; and a light controller configured to control the light source, wherein the light source is disposed on an extension line of the stopper when the stopper is in the first position, the extension line extending in substantially the vertical direction through the stopper when the stopper is in the first position, wherein the stopper is made of transparent resin, and wherein a surface of the stopper is grained.

2. The recording apparatus according to claim 1, wherein the conveyer is configured to output the recording medium at a speed, such that the recording medium passes over the holder, when the stopper is not disposed in the first position.

3. The recording apparatus according to claim 1, further comprising a base disposed upstream from the stopper along a vertical direction, wherein the base is configured to support the recording apparatus while the recorder records an image on a recording medium, and wherein the end of the stopper is disposed further downstream along the vertical direction than the holder.

4. The recording apparatus according to claim 1, further comprising a base disposed upstream from the stopper along a vertical direction, wherein the base is configured to support the recording apparatus while the recorder records an image on a recording medium, and wherein the stopper comprises a plate and the plate extends in substantially the vertical direction when the stopper is in the first position.

5. The recording apparatus according to claim 4, wherein the output direction is substantially perpendicular to the vertical direction.

6. The recording apparatus according to claim 4, wherein the plate extends in substantially a horizontal direction when the stopper is in the second position.

7. The recording apparatus according to claim 1, wherein the urging member is a spring.

8. The recording apparatus according to claim 1, wherein the stopper is configured to move selectively between the first position and the second position by rotating about an axis of rotation.

9. The recording apparatus according to claim 1, wherein the stopper is configured to return to the first position unless a force external to the recording apparatus acts on the stopper, and wherein the force external to the recording apparatus is greater than an urging force generated by the urging member.

10. A recording apparatus comprising:

a recorder configured to record an image on a recording medium at a recording position;

a conveyer configured to convey the recording medium through the recording position and to output the recording medium along an output direction;

a holder configured to hold a recording medium output by the conveyer;

a stopper disposed downstream of the holder in the output direction, wherein the stopper is configured to contact an end of a recording medium when the recording medium is output by the conveyer and the stopper is in a first position;

a light source configured to illuminate the stopper; and a light controller configured to control the light source, wherein the light source is disposed on an extension line of the stopper when the stopper is in the first position is in the first position, the extension line extending in substantially the vertical direction through the stopper when the stopper is in the first position, wherein the stopper is made of transparent resin, and wherein a surface of the stopper is grained.

11. The recording apparatus according to claim 10, wherein the stopper is configured to be disposed at one of a plurality of contact positions along the output direction, wherein each contact position of the plurality of contact positions corresponds to one of a plurality of sizes of recording media.

12. The recording apparatus according to claim 11, wherein the plurality of contact positions comprises a particular contact position, and wherein the light source comprises a particular separate light source disposed to face the particular contact position.

13. The recording apparatus according to claim 12, further comprising a cover configured to cover the particular separate light source when the stopper is disposed at another contact position of the plurality of contact positions that is different from the particular contact position, wherein the cover is disposed between the particular separate light source and the stopper when the stopper is disposed at another contact position of the plurality of contact positions that is different from the particular contact position.

14. The recording apparatus according to claim 13, wherein the light source comprises a plurality of separate light sources, wherein each separate light source of the plurality of separate light sources is disposed to face a respective one of the plurality of contact positions, wherein the plurality of separate light sources comprises the particular separate light source, and wherein the cover is configured to slide along the output direction, such that the cover covers each separate light source of plurality of separate light sources that faces a contact position of the plurality of contact positions that is different from the particular contact position when the stopper is disposed at the particular contact position.

15. The recording apparatus according to claim 11, wherein the light source comprises a plurality of separate light sources, and wherein each separate light source of the plurality of separate light sources is disposed to face a respective one of the plurality of contact positions.

16. The recording apparatus according to claim 15, further comprising a cover configured to cover separate light sources of the plurality separate light sources that face contact positions of the plurality of contact positions that are different from the one of the plurality of contact positions at which the stopper is disposed.

17. The recording apparatus according to claim 16, wherein the cover is configured to slide in the output direction and in a direction opposite to the output direction.

18. The recording apparatus according to claim 15, further comprising a sensor configured to output a signal relative to a position of the stopper among the plurality of contact positions, wherein the light controller is configured to control the light source, such that a separate light source of the plurality of separate light sources that corresponds to the one of the plurality of contact positions at which the stopper is disposed emits light in accordance with the signal output by the sensor, and such that other separate light sources of the plurality of separate light sources that correspond to contact positions of the plurality of contact positions that are different from the one of the plurality of contact positions at which the stopper is disposed do not emit light in accordance with the signal output by the sensor.

19. The recording apparatus according to claim 11, wherein the light source is fixed to the stopper and is configured to move with the stopper.

20. The recording apparatus according to claim 10 comprising:

a plurality of holders comprising the holder, wherein each holder of the plurality of holders is configured to hold a recording medium output by the conveyer;

a plurality of stoppers comprising the stopper, wherein each stopper of the plurality of stoppers corresponds to a respective one of the plurality of holders; and a plurality of light sources comprising the light source, wherein each light source of the plurality of light sources corresponds to a respective one of the plurality of stoppers, wherein the light controller is configured to control the plurality of light sources, such that a light source that corresponds to a stopper that corresponds to a holder that receives the recording medium therein lights up the stopper.

21. The recording apparatus according to claim 10, further comprising:

a housing configured to store the recorder and the conveyer therein; and a base disposed upstream from the stopper along a vertical direction, wherein the holder is disposed at a surface of a wall of the housing, wherein the wall of the housing is a farthest downstream wall of the housing along the vertical direction, and wherein the surface is a downstream surface of the wall of the housing.

22. The recording apparatus according to claim 10, further comprising:

a display configured to display a status of the recording apparatus thereon;

a display controller configured to control the display to display in a display mode selected from a plurality of display modes based on the state of the recording apparatus; and a base disposed upstream from the stopper along a vertical direction, wherein the base is configured to support the recording apparatus while the recorder records an image on a recording medium, and wherein an end of the stopper is disposed further downstream along the vertical direction than the display.

23. The recording apparatus according to claim 22, wherein the light controller is configured to cooperate with the display controller and to control the light source to emit light in cooperation with the display.

24. The recording apparatus according to claim 10, further comprising a base disposed upstream from the stopper along a vertical direction, wherein the base is configured to support the recording apparatus while the recorder records an image on a recording medium, and wherein an end of the stopper is disposed further downstream along the vertical direction than the holder.

25. The recording apparatus according to claim 24, wherein the end of the stopper is disposed farther downstream along the vertical direction than all other portions of the recording apparatus.

26. The recording apparatus according to claim 10, wherein the conveyer is configured to output the recording medium at a speed, such that the recording medium would pass over the holder in a configuration in which the stopper is not disposed downstream of the holder in the output direction.

27. The recording apparatus according to claim 26, wherein the stopper is configured to move selectively between the first position and a second position, in which an end of the stopper is farther to the holder than when in the first position, and wherein the recording apparatus further comprises an urging member configured to urge the stopper to move to the first position from the second position.

28. The recording apparatus according to claim 10, wherein the light controller is configured to control the light source to emit light in an emission mode selected from a plurality of emission modes based on a status of the recording apparatus.

29. The recording apparatus according to claim 28, wherein the light controller is configured to control the light source to emit light in a predetermined emission mode when the recording apparatus is in an error status.

* * * * *